US007963206B2

(12) United States Patent
Bartle

(10) Patent No.: US 7,963,206 B2
(45) Date of Patent: Jun. 21, 2011

(54) APPARATUS FOR SIGHTING-IN A GUN

(76) Inventor: David Eric Bartle, Jindabyne (AU)

( * ) Notice: Subject to any disclaimer, the term of this patent is extended or adjusted under 35 U.S.C. 154(b) by 0 days.

(21) Appl. No.: 11/884,518

(22) PCT Filed: Feb. 15, 2006

(86) PCT No.: PCT/AU2006/000194

§ 371 (c)(1),
(2), (4) Date: Dec. 26, 2007

(87) PCT Pub. No.: WO2006/086836

PCT Pub. Date: Aug. 24, 2006

(65) Prior Publication Data

US 2008/0209790 A1 Sep. 4, 2008

(30) Foreign Application Priority Data

Feb. 15, 2005 (AU) ..... 2005900698

(51) Int. Cl.
*F41A 23/60* (2006.01)

(52) U.S. Cl. ..... 89/37.04; 42/94

(58) Field of Classification Search ..... 89/37.04; 42/94

See application file for complete search history.

(56) References Cited

U.S. PATENT DOCUMENTS

| | | | | |
|---|---|---|---|---|
| 882,988 | A * | 3/1908 | Aloyos et al. | 89/41.01 |
| 1,190,121 | A | 7/1916 | Critchett | |
| 2,378,545 | A * | 6/1945 | Fraser et al. | 73/167 |
| 3,358,504 | A * | 12/1967 | Freebairn | 73/167 |
| 3,492,733 | A | 2/1970 | Leatherwood | |
| 3,948,587 | A | 4/1976 | Rubbert | |
| 4,333,385 | A | 6/1982 | Culver | |
| 4,403,421 | A | 9/1983 | Shepherd | |
| 4,409,826 | A | 10/1983 | Wenger | |
| 4,621,563 | A * | 11/1986 | Poiencot | 89/37.04 |
| 5,070,636 | A | 12/1991 | Mueller | |
| 5,081,783 | A * | 1/1992 | Jarvis | 42/94 |
| 5,375,804 | A | 12/1994 | Levilly | |
| 5,661,919 | A * | 9/1997 | Pryor | 42/94 |
| 2009/0205238 | A1 * | 8/2009 | Willis, Jr. | 42/94 |

* cited by examiner

FOREIGN PATENT DOCUMENTS

| | | |
|---|---|---|
| AU | 200215404 B2 | 3/2002 |
| DE | 200 16 345 | 3/2001 |

*Primary Examiner* — Stephen M Johnson
(74) *Attorney, Agent, or Firm* — Scully, Scott, Murphy & Presser, P.C.

(57) ABSTRACT

To sight-In a gun—especially a rifle (10)—it has to be held in the same position while it is fired at least twice, the gunsight (14) being adjusted after the first shot so that the gun sight shows the gun aimed at the point of impact of the first shot on the target. Apparatus to hold the gun while sighting-in is performed has a base (16) on which an elogate support frame (40) is mounted. The support frame (40) carries a rear stock clamping arrangement, with which clamping members (21) firmly hold the rear stock (11) of the gun. A gun barrel (13) or front stock (12) locating arrangement (30,31,32,34,37,39), also carried by the support frame, ensures that the front stock (or barrel) of the gun can be repositioned (if it has not been clamped) in the same position after a shot has been fired. Mounting blocks (115, 116) clamped to the base (16) include means to make fine adjustments of the lateral pointing of the gun. Course variation of the vertical pointing of the gun is effected by changing the height above the support frame (40) of a horizontal bar (30) of the front stock locating arrangement. Fine adjustment of the vertical pointing of the gun is effected by movement of pivot arms (24), on which the rear stock clamping members (21) are carried, about a pivot axis (27). Straps to prevent or limit gun movement due to recoil may be included.

20 Claims, 8 Drawing Sheets

APPARATUS FOR SIGHTING-IN A GUN

TECHNICAL FIELD

This invention concerns guns. More particularly, it concerns the sighting-in of rifles and pistols (whether using rim fire or centre fire cartridges), shotguns, pneumatic rifles and other hand-held guns. The term "sighting-in of a gun" means the adjustment of the sighting system of the gun so that the accuracy with which any bullet, shell or quantity of shot, that has been fired from the gun, arrives at the intended target is optimised.

BACKGROUND TO THE INVENTION

On a rifle range or pistol range, knowledge of the accuracy of a rifle, shotgun or pistol is necessary if a shooter is to determine where to aim to hit a target (or to group shot on a target in the case of a shotgun). Acquiring that knowledge has been a problem for many years. All manufacturers of firearms perform some sighting-in of the guns they manufacture, but each owner of a gun has to work out, independently, how to aim the gun to have the best chance of success.

In the specification of Australian patent application No. 15404/02, entitled "Apparatus and method for calculating aiming point information for rifle scopes", the factors that contribute to inaccuracy in aiming a gun are outlined. The proposals for improving aiming that are found in the specifications of U.S. Pat. No. 1,190,121 (to Critchett), U.S. Pat. No. 3,948,587 (to Rubbert), U.S. Pat. No. 3,492,733 (to Leatherwood) and U.S. Pat. No. 4,403,421 (to Shepherd) are discussed and the reasons for the failure of those proposals are noted. After this discussion, a reticule for a telescopic gun sight which can be calibrated automatically by using a hand-held electronic ballistics calculator is described. The hand-held electronic ballistics calculator is a computer containing a ballistics program which uses data (including some or all of temperature, wind speed and wind direction, barometric pressure, relative humidity and the slope of the ground over which a bullet will be fired) to align the novel reticule for accurate marksmanship. When the result of the aiming of the rifle is known, the ballistics calculator indicates the changes in the set-up parameters that are needed to improve the aiming of the rifle.

The device of patent application No. 15404/02, however, appears to be designed for use by hunters, who need to shoot over long distances. In addition, the setting up of the device requires knowledge that is often not available, and the parameters selected (especially wind speed and wind direction) can vary significantly in a very short time.

DISCLOSURE OF THE INVENTION

Preliminary note: In this specification, "directional" terms (such as "top", "bottom", "upper", "lower", "front", "back", "rear", "above", "below", "vertical", "horizontal" and "side") will be used in the sense that they would have with reference to an embodiment of the invention positioned as shown in FIG. 1 of the accompanying drawings.

It is an objective of the present invention to provide apparatus which enables a shooter to perform sighting-in of a gun, particularly a gun to be used in ranges over predetermined distances from the rifle to the target of up to 1,000 meters, and even over more than 1,000 meters.

This objective is achieved by providing apparatus that can be used with a rifle, shotgun or pistol having any conventional type of gun sight. This apparatus comprises a generally elongate support frame, having a front end and a back end at opposite ends of the elongate direction of this frame. A front stock (or barrel) locating means is mounted at or near the front end of the support frame, and a rear stock clamping means is mounted at or near the back end of the support frame.

The support frame itself is mounted on a pair of base connection blocks (a front connection block and a back connection block) that are adapted to be clamped to a base. The base may be any heavy, stable structure of metal, wood or other rigid material (for example, a purpose-built concrete block). The important characteristic of the base is that has a high mass compared with the gun, and that it is not affected by the recoil that is experienced when the gun is fired.

The front stock (or barrel) locating means comprises a rigid horizontal bar mounted on the support frame, with the elongate direction of the horizontal bar being transverse the elongate direction of the support frame. Locating means, typically a pair of locating members in the form of blocks, which may have pads attached to their opposed surfaces and which are moveable along the top of this horizontal bar, ensures that the front stock (or barrel) is positioned as required above this bar. The positions of these blocks on the horizontal bar may be controlled by respective block moving means, supported on or close to an end of the horizontal bar. Alternatively, the blocks may be manually located in their required positions on the bar, and then be clamped to the bar in those required positions. When the invention is in use, the front stock (or the barrel) of the gun rests on the top surface of the horizontal bar (that top surface being preferably covered, at least over its central region, with a layer of a rubber material, neoprene, or a suitable plastics material) and the locating blocks are moved until each block bears against a respective side of the front stock (or barrel) of the gun, thus preventing sideways movement of the front stock (or barrel). Normally, the locating blocks in this position will not clamp the front stock (or barrel) of the gun, but individual shooters may use these blocks as a clamping device. In the following description, it will be assumed that these locating blocks do not clamp the front stock or barrel of the gun.

The rear stock clamping means includes a pair of clamping members, each of which has a substantially vertical surface that is opposed to the vertical surface of the other clamping member (in other words, the substantially vertical surfaces are mutually opposed). The clamping members are adapted to be moved laterally relative to the elongate direction of the support frame, so that the vertical surfaces contact the side faces of the rear stock of the rifle or shotgun (or the side faces of the handle of a pistol). Preferably, these clamping members are mounted on bearings for rotation about respective horizontal axes, which are at right angles to the substantially vertical surfaces of the clamping members. These axes of rotation are substantially co-linear.

With such front stock (or barrel) locating means and rear stock clamping means, when a gun that is being sighted-in is fired, the recoil effect of firing the gun causes the gun barrel to lift and the entire gun to be rotated (by an amount which is dependent on the strength of the recoil effect) about the axes of rotation of the rear stock clamping members. However, the lateral positions of the locating pads on the horizontal bar should not change during this rotation of the gun and, since neither rear stock clamping member moves laterally, after the recoil effect, the gun can be relocated in precisely the same position on the support frame that it had before the gun was fired.

Embodiments of the invention will also include gun tilting means, to raise or lower the horizontal bar of the front stock (or barrel) locating means relative to the top of the support frame, and/or to raise or lower the rear stock clamping members relative to the top of the support frame, and, thereby, to lower or raise the front of the barrel of the gun relative to its rear stock (if a rifle) or its handle (if the gun is a pistol).

Thus the present invention provides apparatus for use in the sighting-in of a gun, said gun having a barrel, a rear stock and (if the gun is a rifle) a front stock; said apparatus comprising:

a) a generally elongate support frame having a front end and a back end;

b) a base on which said support frame is mounted;

c) means for locating the front stock, the means for locating the front stock being mounted on the support frame at or near the front end, the means for locating the front stock comprising: (1) a first horizontal bar supported above the support frame, and extending in a direction transverse to the elongate direction of the support frame, and (2) means for prevention of sideways movement of the front stock, the means for prevention of sideways movement being mounted on the first horizontal bar;

d) means for clamping the rear stock, the means for clamping the rear stock being mounted on the support frame at or near the back end, the means for clamping the rear stock comprising a pair of stock clamping members, each stock clamping member having a substantially vertical surface which is opposed to the substantially vertical surface of the other stock clamping member, each stock clamping member being moveable laterally relative to the elongate direction of the support frame, so that, when the sighting-in apparatus is in use, each of the vertical surfaces may be moved to contact a respective side face of the rear stock, each of the stock clamping members being mounted on a respective axle at an end of a respective horizontal rod which extends away from the associated stock clamping member in a direction substantially at right angles to both the substantially vertical surfaces of the clamping members and the elongate direction of the support frame, each horizontal rod having a portion thereof which is externally threaded, each of the horizontal rods passing through an internally threaded aperture in a respective support block, with the externally threaded portion engaging with the internal threads of the internally threaded aperture, whereby rotation of each horizontal rod causes its associated axle to move towards or away from the rear stock and thereby provide the lateral movement of each stock clamping member; and e) means for increasing and decreasing the distance between the support blocks and the support frame, thereby, when the apparatus is in use, to raise or lower the rear stock relative to the support frame, and thus to lower or raise the barrel of the gun relative to the rear stock.

Embodiments of the invention, including these and other features of the present invention (some being optional features) will now be described, by way of example only. In the following description, reference will be made to the accompanying drawings.

DETAILED DESCRIPTION OF THE ILLUSTRATED EMBODIMENTS

Figure 1:
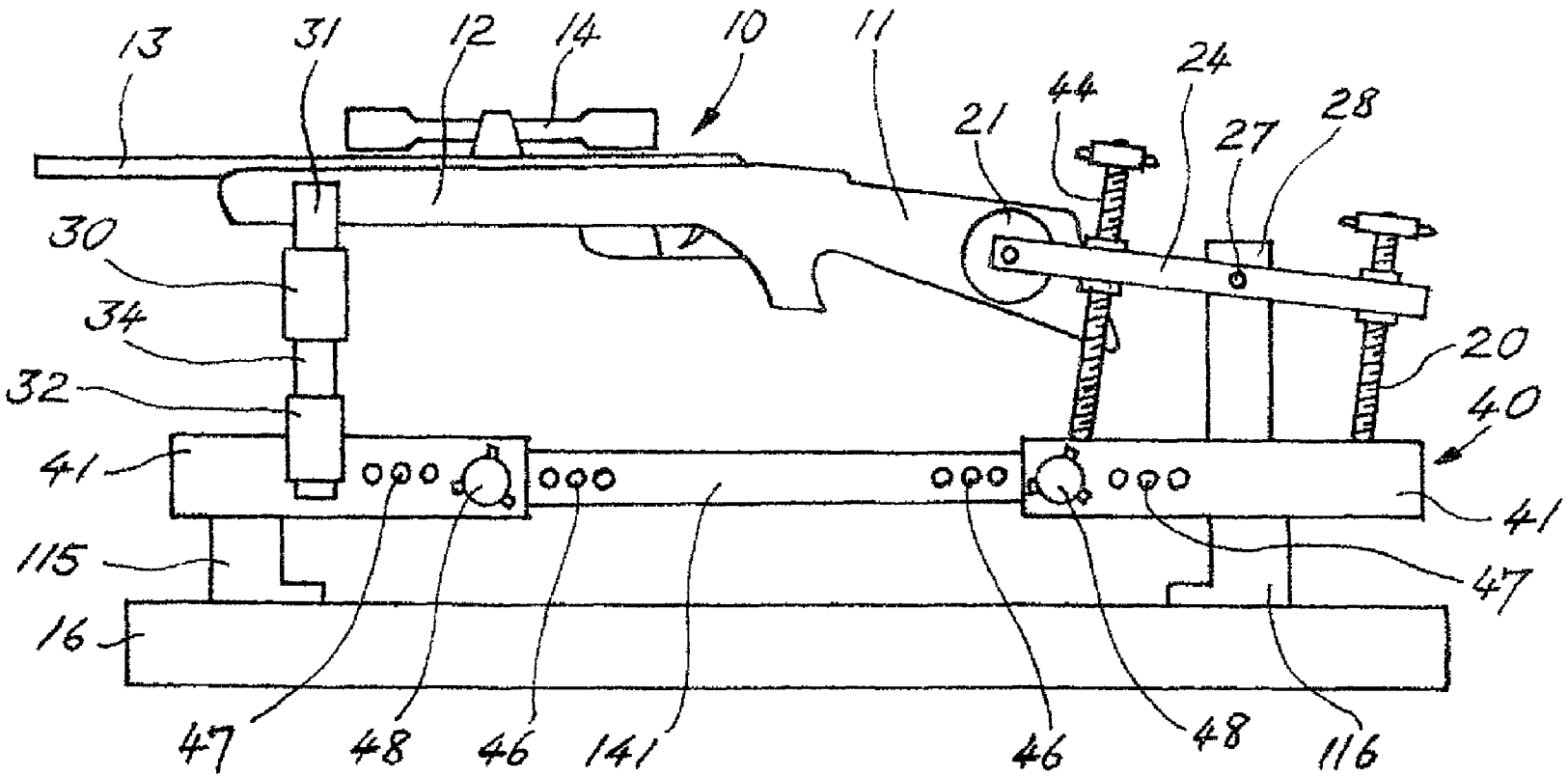
FIG. 1 is a partly schematic side view of one form of gun sighting-in apparatus constructed in accordance with the invention, mounted on a base, with a rifle in position on the apparatus.
Figure 2:
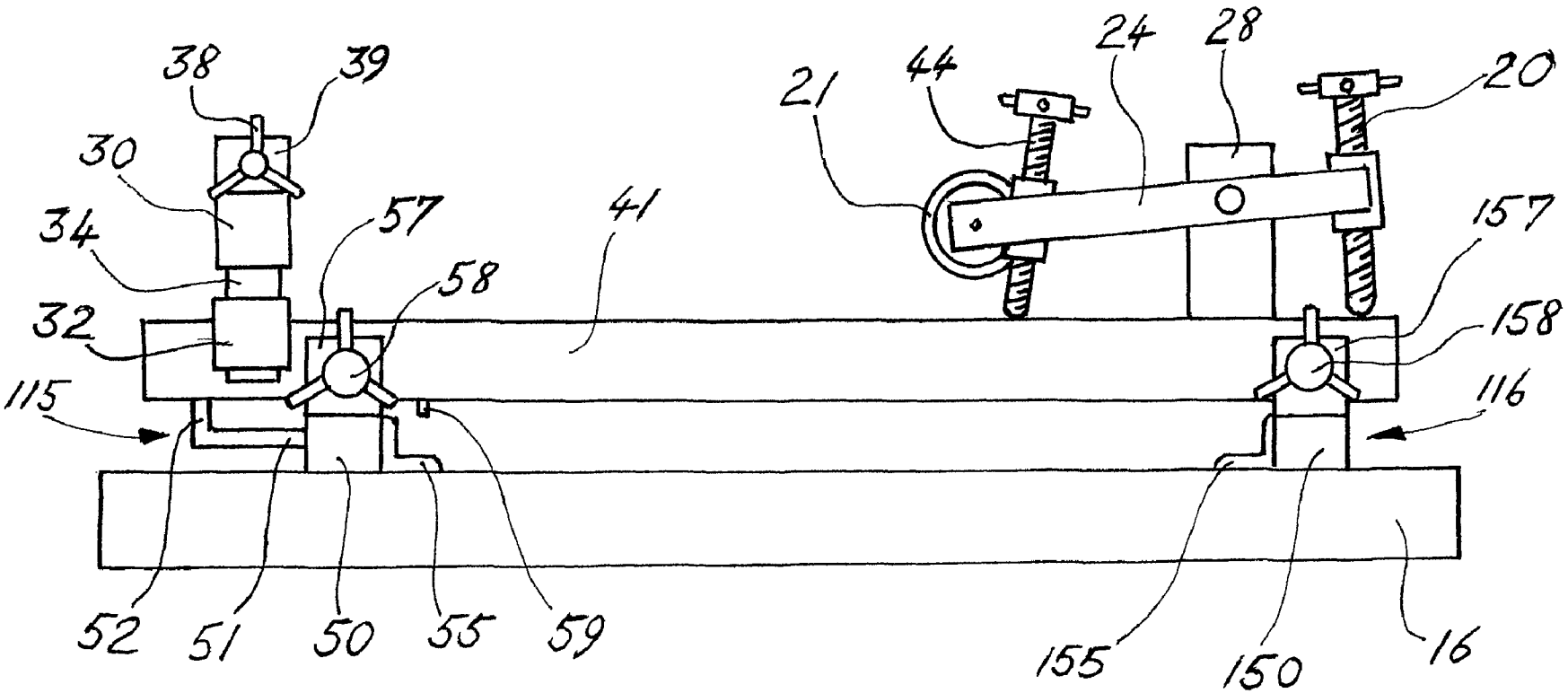
FIG. 2 is a side view of a prototype of the invention.

FIG. 1 shows a rifle 10 having a rear stock 11 which extends to a front stock 12. This rifle has a barrel 13. A telescopic sight 14 is mounted on the rifle 10. The rear stock (sometimes called the butt stock) 11 of the rifle 10 is held firmly by a pair of clamping members 21 of a stock clamping means mounted on a support frame 40. The front stock 12 (or the barrel 13) is located between a pair of pads 31 of a front stock (or barrel) locating means, which is also mounted on the support frame 40.

The support frame 40 is held firmly on a pair of mounting blocks 115 and 116 which are clamped to a base 16. Normally, the front mounting block 115 is the first mounting block to be clamped onto the base 16 and the rear mounting block 116 is then moved fore and aft until it is located in a required (or an appropriate) position, prior to its clamping onto the base 16.

In a prototype of the invention, constructed by the inventor, the support frame 40 comprises a pair of parallel, elongate, spaced apart, square-section side members 41, connected to each other by two spaced apart, short, transverse square-section transverse members 42. (More than two transverse members may be included in a support frame.) Both the side members 41 and the transverse members 42 of the prototype apparatus are made of steel, and the ends of the transverse members are welded to the inside vertical walls of the side members 41. However, it will be appreciated that the side members 41 need not be parallel to each other (although this will usually be the case) and the transverse members 42 a) need not have a square or rectangular cross-section, b) can be constructed of materials other than steel, c) may not be welded to each other but, instead, may be rigidly connected to each other using other known methods and materials, and d) may be solid or hollow.

The support frame 40 shown in FIG. 1 is constructed of two sub-frames which have side members which are parallel to each other and which (a) in part, fit telescopically, one within the other; or (b) are slidable over a central frame support rod (rod 141 in FIG. 1).

Apertures 46 and 47 are provided, respectively, in the side members 40 and the central frame support rod 141, so that the support frame can be lengthened or shortened as required, with associated pins, bolts or other suitable retaining means being inserted into aligned apertures 46 and 47 to locate the side members in a required position before they are clamped using clamps 48. If the side members can be substantially shortened, the same equipment may be able to be used for sighting-in pistols, rifles and shotguns. If the side members cannot be shortened sufficiently, or cannot be shortened at all, rifles and shotguns of similar, but different, lengths will normally be able to be sighted-in using the apparatus, but a separate support frame will be required for sighting-in a pistol.

Figure 3:
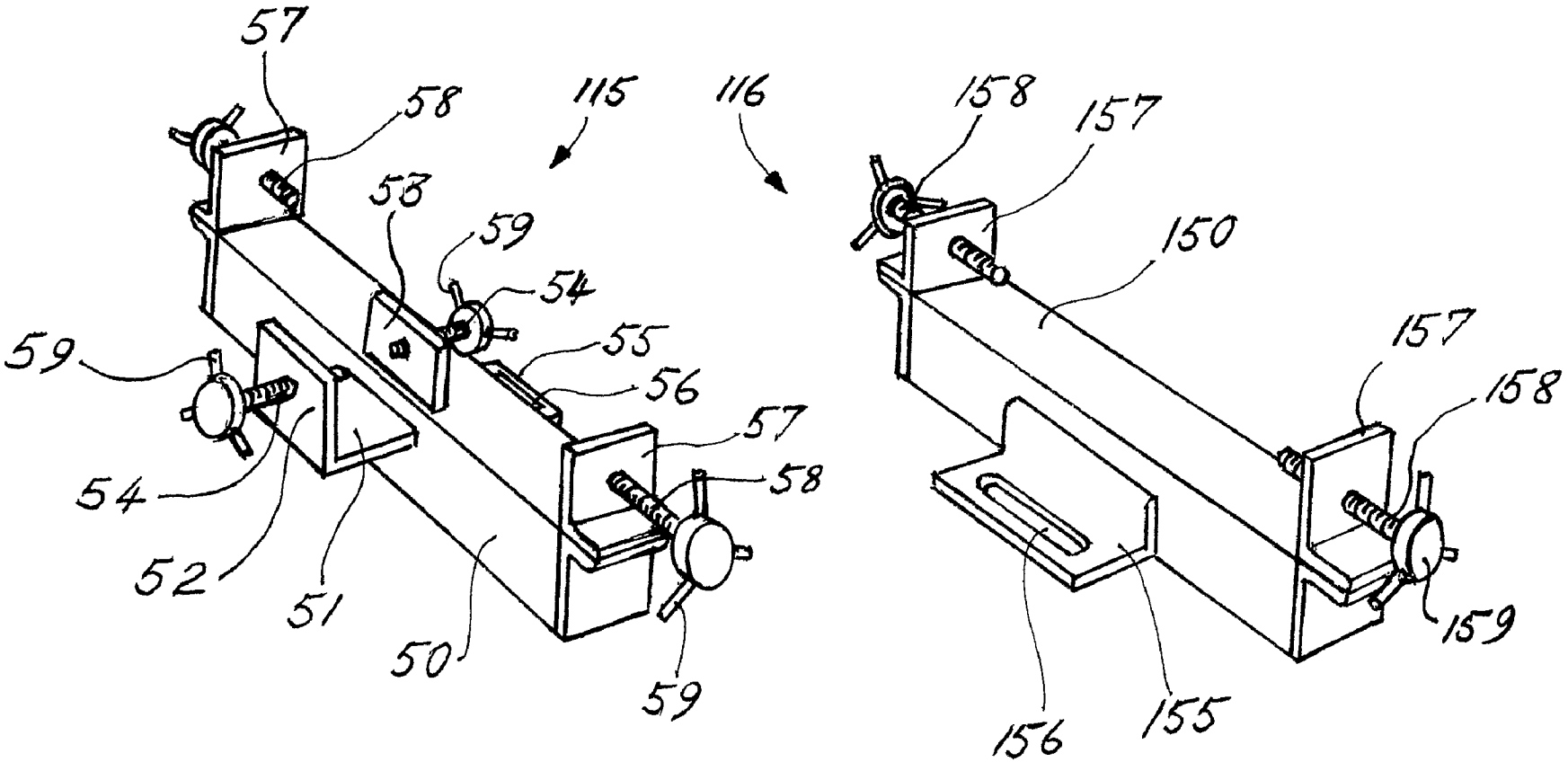
FIG. 3 is a perspective sketch of the front and rear mounting blocks used, in the prototype apparatus shown in FIG. 2, to connect the support frame to a base.

The front mounting block 115 shown in FIG. 3 is designed to enable the support frame to be mounted securely on the base 16. In the prototype equipment that has been constructed by the inventor, this mounting block comprises an elongate transverse block member, in the form of a length of rectangular steel tubing 50, on to which are welded (1) a central cradle, into which a transverse member 42 of the support 40 may be positioned, this central cradle comprising a horizontal plate 51 and a pair of upright (vertical) planar plates (a first vertical plate 52 and a second vertical plate 53), each with an associated position adjustment and clamping screw 54, which is controlled by a "handle" 59;
(2) a lower horizontal plate 55 (embodied as a clamping plate) containing a slot or an aperture 56, through which a bolt can be extended (or through which a bolt extending from the base 16 may pass) to enable the clamping plate to be clamped to the base 16; and
(3) a pair of vertical side flanges (third and fourth vertical plates) 57 with associated adjusting/clamping screws 58.

The spacing of the side flanges (the third and fourth vertical plates) 57 is such that the side members 41 of the support frame 40 are a loose fit between the flanges 57, and the adjusting/clamping screws 58 can be used to adjust—in a limited way— the lateral position of the support frame 15 and then clamp the support frame in its required lateral position. The rear mounting block 116 is similar to the front mounting block 115, comprising a length of rectangular steel tubing 150 on to which are welded a pair of vertical side flanges (fifth and sixth vertical plates) 157 with associated adjusting/clamping screws 158. However, the cradle arrangement consisting of the horizontal plate 51 and the vertical flanges 52 and 53, 20 with their associated clamping/adjusting screws 54, is omitted. This omission enables the rear mounting block 116 be moved to different locations on the base if (a) the length of the support frame 40 is adjustable, and/or (b) the length of the base 16 is limited.

The rear mounting block 116 is similar to the front mounting block 115, comprising a length of rectangular steel tubing 150 on to which are welded a pair of vertical side flanges 157 with associated adjusting/clamping screws 158. However, the cradle arrangement consisting of the horizontal plate 51 and the vertical flanges 52 and 53, with their associated clamping/adjusting screws 54, is omitted. This omission enables the rear mounting block 116 be moved to different locations on the base if (a) the length of the support frame 40 is adjustable, and/or (b) the length of the base 16 is limited.

The lower horizontal plate members (clamping plates) 55 and 155 of the front and rear mounting 25 blocks 115 and 116 are secured to the base 16, typically by bolts which pass upwardly from, or downwardly into, the base 16 through the respective slots 56 and 156 in the plate members (horizontal clamping plates) 55 and 155. Respective nuts are tightened onto the bolts that pass upwardly from the base 16 through the slots or apertures 56 and 156; the bolts that pass downwardly through the slots 56 and 156 engage with, and then are tightened into, respective threaded apertures in (or nuts held in position on or in) the 5 base 16. If the length of the support frame is adjustable, the top surface of the base will normally contain a linear array of bolts or threaded apertures, so that a support frame having any one of a number of support frame lengths can be secured to the base 16.

Other, known, arrangements for clamping the support frame to the base may be used.

It should be appreciated that the mounting blocks 115 and 116 may be reversed. That is, the mounting block 116 shown in FIG. 3 may be used as the front mounting block, and the mounting block 115 of FIG. 3 may be used as the rear mounting block. It is also possible for other types of mounting blocks to be used in place of the blocks 115 and 116. Also, the mounting blocks may be made of another suitable rigid material, instead of steel, and one mounting block or more than two mounting blocks may be used to mount the support frame 40 on the base 16. The (or each) mounting block used may have any suitable shape, provided it can hold the support frame effectively, It may be a solid or a hollow structure. In addition, a) only one clamping/adjusting screw 58 and only one clamping/adjusting screw 158 may be used, or
b) more than two clamping/adjusting screws 58 and more than two clamping/adjusting screws 158 may be used, and
c) alternatives to the "handles" 59 and 159 may be used to control the clamping/adjusting screws (this comment concerning handles applies to all adjusting screws illustrated in the accompanying drawings).

Figure 4:
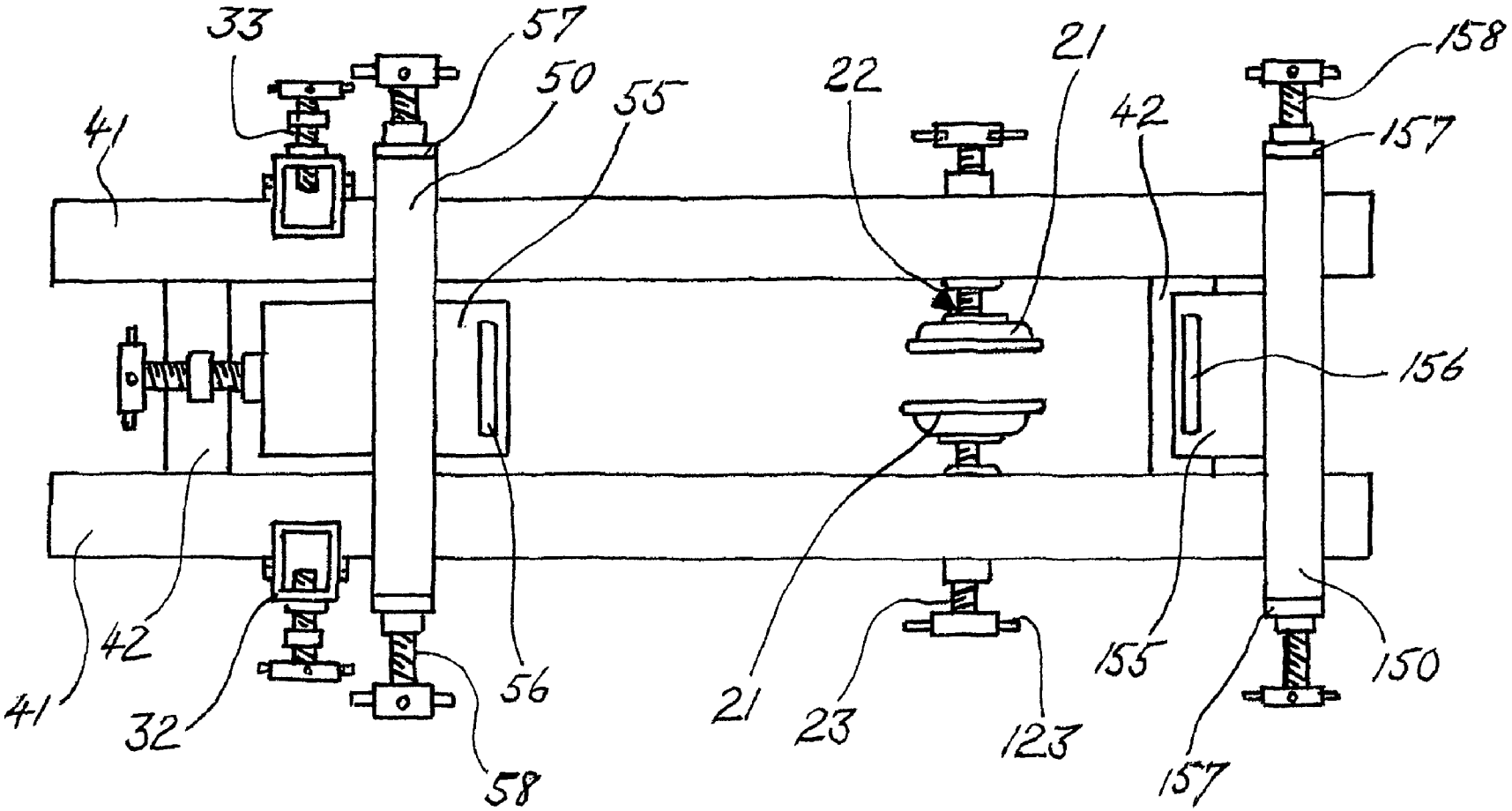
FIG. 4 is a plan view, from below, of the prototype apparatus of FIG. 2.
Figure 5:
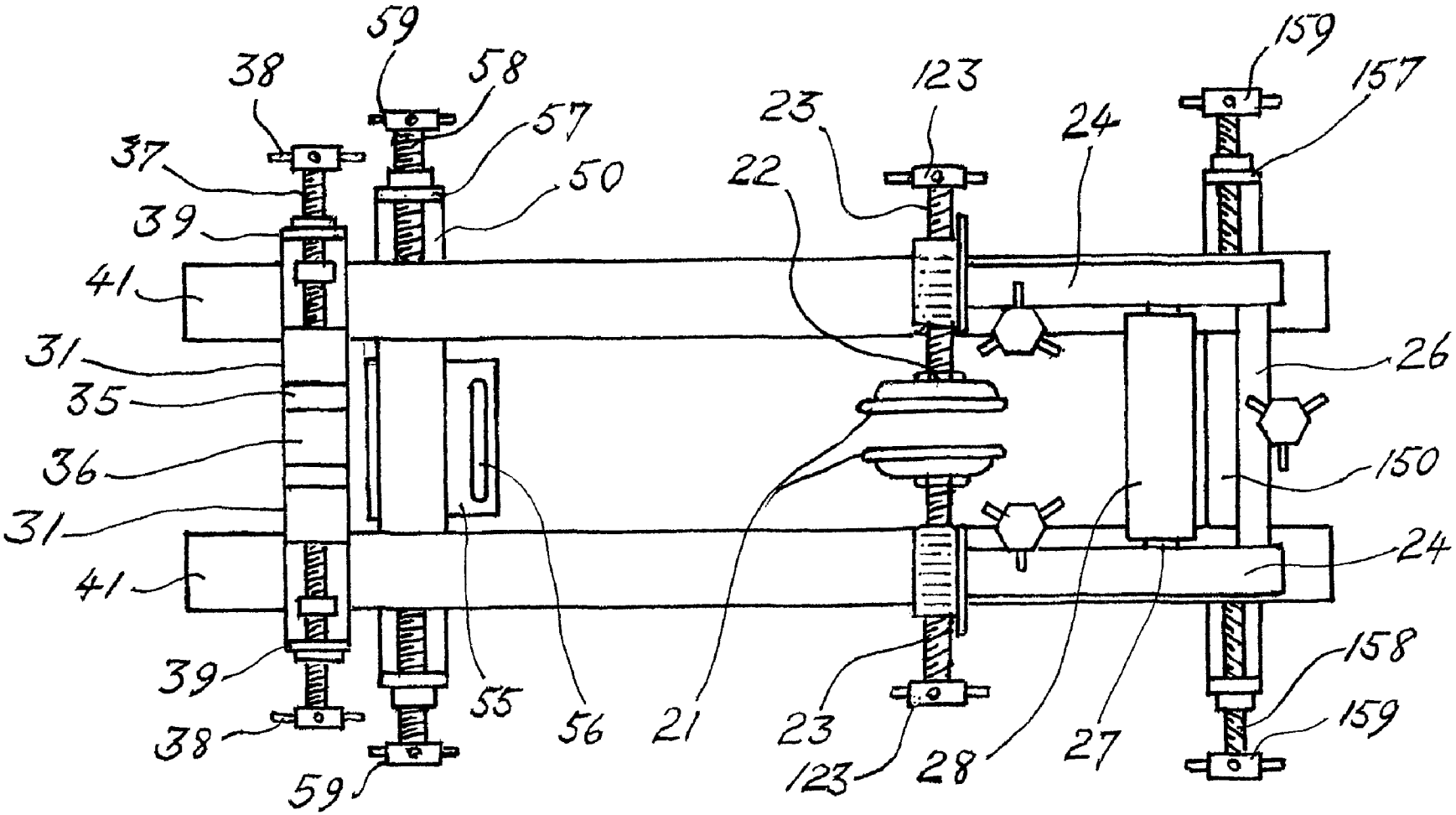
FIG. 5 is a plan view, from above, of the prototype apparatus of FIG. 2, but with some of the mechanisms for mounting the support frame on the base omitted, for clarity.
Figure 6:
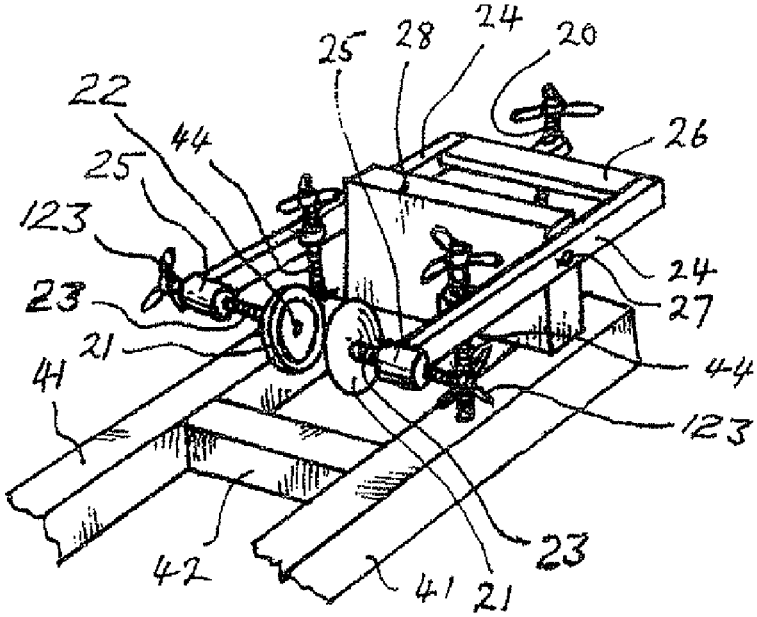
FIG. 6 is a partly schematic perspective sketch of the stock clamping means of the prototype apparatus, mounted on the support frame.

The rear stock 11 of the rifle 10 is clamped in position by a pair of stock clamping members 21. As shown in FIGS. 4, 5 and 6, the stock clamping members 21 are disc-like in shape and are each mounted on bearings on a respective clamping member support which, in the illustrated embodiment, is an axle 22, about which they are able to rotate freely. (However, the stock clamping members 21 need not be disc-like, as shown, but may have any suitable peripheral shape, and they may be provided with bushes, ball joints, thrust bearing devices, or another suitable mounting arrangement which permits their rotation. In addition, to prevent movement of the gun due to the recoil effect, each stock clamping member 21 may be rigidly—that is, non-rotatably—affixed to its associated clamping member support (for example, by being welded to it).

Each axle 22 of the illustrated (prototype) embodiment is formed integrally with, or is attached to one end of, a respective threaded rod 23, which passes through an internally threaded horizontal aperture in a support block 25. Rotation of a handle 123 (or its equivalent) at the outer end of each rod 23 moves the inner end of the rod 23 (and thus also moves the associated axle 22 with its bearing and clamping member) towards or away from the inner end of the other rod 23 (and its associated axle 22, bearing and stock clamping member 21). Thus when a rifle is positioned on the sighting-in apparatus as shown in FIG. 1, the handles at the end of the rods 23 are rotated so that the stock 11 of the rifle 10 is clamped between the clamping members 21. The vertical face of each clamping member 21 (which may be annular, or any other suitable shape, and thus not extend over the entire clamping member) will normally be coated with a layer of rubber, neoprene, or a similar compressible and resilient material, to ensure that the rear stock 11 is not damaged when it is held firmly (that is, clamped) between the two stock clamping members 21.

In the embodiment shown in FIG. 6, each support block 25 is mounted at or near the forward end of a respective tilt arm 24 and is positioned above an associated side member 41 of the support frame 40. The other (rear) ends of the two tilt arms 24 are connected by a horizontal connecting bar 26. Each arm 24 is mounted on a respective pivot axle or stub axle 27 that passes through, or is mounted on, a transverse pivot block 28. The pivot block 28 is mounted securely on the support frame 40 and extends from the top of one side member 41 of the support frame to the top of the other side member 41. In the prototype apparatus, the pivot block 28 is of steel and is welded to the elongate side members 41 of the support frame. However, a) other rigid materials may be used for the pivot block;
b) joining methods other than welding may be used to mount the pivot block on the support frame;
c) the pivot block may have any suitable shape, and it may be a solid or a hollow structure; and
d) the support frame and pivot block may be formed integrally (for example, as a cast or moulded unit).

The height of the clamping members 21 above the support frame 40 is controlled by a worm and nut arrangement consisting of (a) a threaded rod 20 (the worm) which passes through a threaded aperture (the nut) in a block welded to the horizontal connecting bar 26 (or which passes 20 through a nut or nuts welded to that horizontal bar), and (b) two threaded rods 44, each of which passes through a threaded aperture in a block 144 welded to a respective one of the arms 24 (or which passes through a nut or nuts welded to the respective arm 24). The lower end of the threaded rod 20 bears against a transverse member of the support frame 40 (or, in the absence of a suitably positioned 25 transverse member, a transverse plate or flat-topped bar which is supported on—typically, welded to— the top of the side members 41). The lower end of each rod 44 bears against the top surface of a respective side member 41 of the support frame.

Instead of a single threaded rod 20 mounted substantially centrally on the horizontal bar 26 (as shown in FIGS. 5 and 6), two threaded rods may be mounted on the horizontal bar 26, preferably symmetrically relative to the front-to-rear centre line of the apparatus and close to a respective arm 24. Alternatively, two threaded rods may be mounted on respective arms 24, near to the horizontal bar 26. With either of these two alternative arrangements, each of the two threaded rods will be used to provide fine adjustment of the position of its associated arm 24. In principle, more than two such threaded rods may be used but, it is believed, more than two such threaded rods are not necessary to produce effective sighting-in apparatus.

Another alternative arrangement is for the threaded adjusting rods 44 to comprise one or more bolts or threaded rods, passing through a transverse bar that is attached to the arms 24. Rotation of the, or each such, bolt or threaded rod will wind down, or up, the transverse bar, thus rotating the arms 24 about their pivot axes 27.

Other mechanically equivalent arrangements may be used instead of the threaded rod 20 (or multiple threaded rods), and instead of other threaded rods in the illustrated embodiments which are used for adjusting and/or clamping purposes. These alternative arrangements include electrically controlled, pneumatically controlled and hydraulically controlled arrangements.

When the illustrated sighting-in equipment is being used with a rifle, the front stock 12 (or the barrel 13) of the rifle 10 rests on the top of the central region of a transverse bar 30 (see FIGS. 7 and 8*a*) that is supported by two posts 34 that pass through respective post-encircling members 32. Each post-encircling member 32 is welded to the outer vertical surface of a respective side member 41 of the support frame 40. Apertures 129 in the post-encircling members 32 and in the posts 34 25 enable pins (or bolts if these apertures are threaded) to be located within apertures 130 in the posts 34, and thus position the horizontal bar 30 at one of a number of pre-determined heights. A respective clamping bolt 33 may be used to prevent movement of each post 34, once the transverse bar 30 is positioned at the required height above the support frame 40.

A pair of blocks 31 (which, in the illustrated embodiment, have respective pads 35 stuck or otherwise fastened onto them) are mounted on top of the transverse bar 30. Each padded block 31

(a) may have its inner face substantially vertical over its lower region, but with its upper inner face angled as shown, and
(b) is connected to the inner end of a respective block adjusting screw 37, and also to a threaded rod 135 which passes through slots 136 in the transverse bar 30 and projects below the transverse bar 30.

Each adjusting screw 37 passes through a respective threaded aperture of a block 39 (or through a nut or nuts) welded to the top surface of the transverse bar 30, adjacent to a respective end of the bar 30. When the sighting-in equipment is in use, rotation of a handle 38 at the outer end of an adjusting screw 37 moves the associated padded block 31 towards or away from the front stock (or the barrel) of the rifle, which will be resting on the top of the bar 30, until the inner, padded face of each block 31 touches, but does not clamp, the front stock 12 (or the barrel 13) of the rifle 10. When the padded blocks 31 are so positioned, the locking nuts 47 on the threaded rods 135 are tightened, to hold the padded blocks 31 firmly in position on the transverse bar 30. In this position, the padded blocks 31 prevent sideways movement of the front stock 12 (or barrel 13). In a simplified version of this equipment, the adjusting screw 37 (with block 39) may be omitted, in which case manual adjustment of the blocks 31 to their required position is effected prior to clamping them in that position.

A strap, preferably of a non-resilient material, may be included as a bridge across the top of the blocks 31 to prevent excess lifting of the barrel of the gun being sighted-in, above the transverse bar 30, due to the recoil action when the gun is fired.

A layer 35 of a rubber compound, neoprene, or a similar compressible and resilient material will usually be bonded to the inner (opposed) faces of the blocks 31 to provide the padding on the blocks 31, and a similar layer 36 will usually be bonded to the central region of the top of the transverse bar 30, to minimise the possibility of damage to the front stock (or to the barrel) of the rifle when the equipment is used for sighting-in the rifle.

Figure 8A:
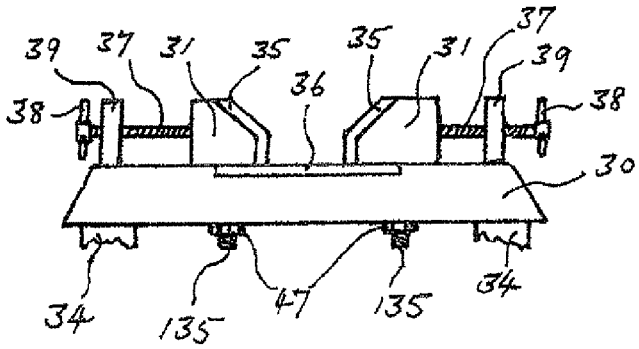
FIG. 8*a* is a view, from the front, of part of the front stock (or barrel) locating means shown in FIG. 7.
Figure 8B:
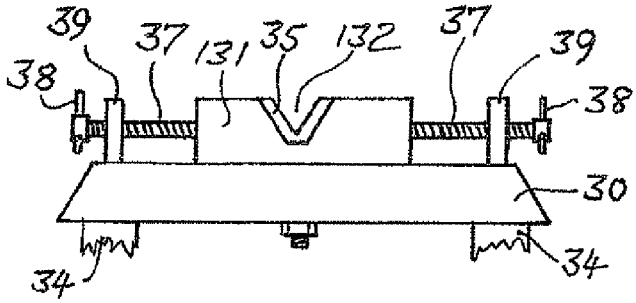
FIG. 8*b* is a view, similar to that of FIG. 8*a*, of an alternative construction of the front stock (or barrel) locating means.

An alternative arrangement, which is illustrated in FIG. 8*b*, is to replace the padded blocks 31 with a single block 131 having a generally V-shaped slot or groove 132 in its upper surface. The slot or groove 132 will have dimensions such that the barrel or front stock of the rifle being sighted-in 10 will be positioned within, and be firmly held by, the side walls of this slot. Such a slotted block may be moveable along the horizontal bar 30 and clampable in a required position, as shown in FIG. 8*b*. Alternatively, it may be formed integrally with the bar 30. Normally, a layer of padding 35 will be provided within the slot, bonded to the side walls of the slot.

Figure 7:
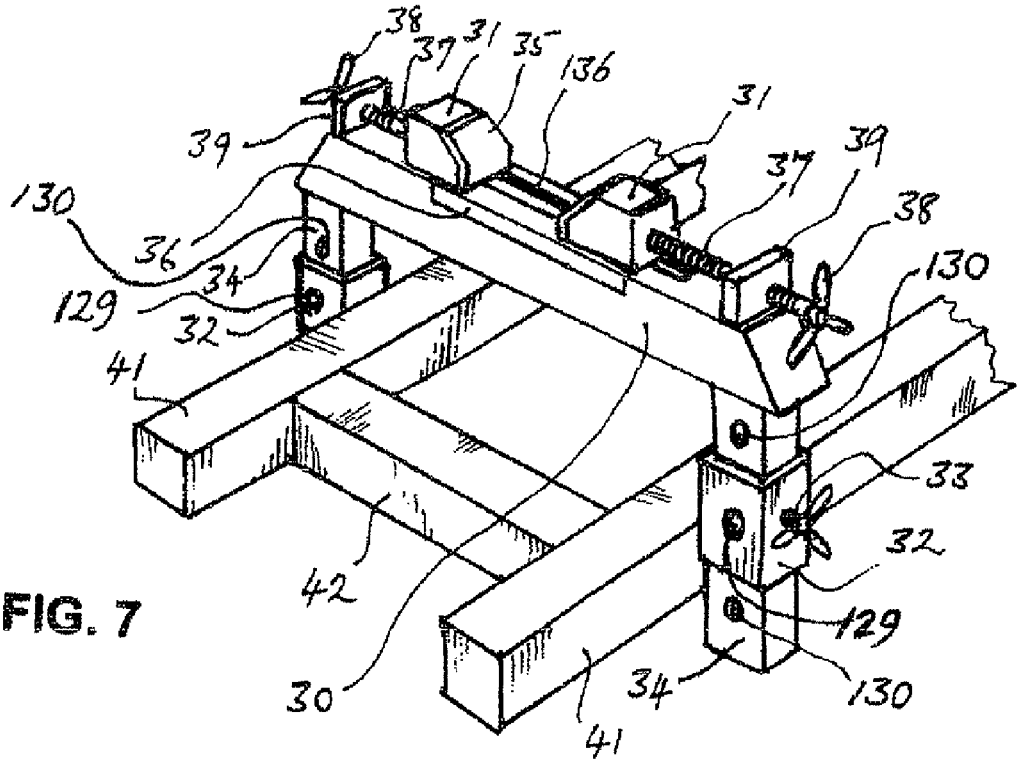
FIG. 7 is a partly schematic perspective sketch of the front stock (or barrel) locating means of the prototype apparatus shown in FIG. 2.

The blocks 31 shown in FIG. 7 and FIG. 8*a* of the accompanying drawings have their, opposed faces 15 constructed so that the lower part of each face is vertical and the upper part of the face is inclined away from the opposed face. With this arrangement, the blocks 31 can be used with the front stock (or barrel) of the gun resting on the horizontal transverse bar 30 (in which case, the blocks 31 may clamp the front stock in position, to prevent its sideways movement), or they may be used with their vertical faces touching each other (in which case, the blocks 31 form a V-shaped slot or groove, in which the barrel of the gun—or the front stock— may be rested, and its sideways movement prevented).

Engineers will appreciate that the transverse bar 30, the posts 34 (and hence the post-encircling members 32) need not-be fabricated, as shown in the accompanying drawings, from steel tubes of rectangular cross-section, but (a) could be made (for example) from steel tubing of circular or other cross-section, or from tubing or solid rods of a rigid material other than steel, having a rectangular, circular or other cross-section; or (b) could be a single, moulded part of the equipment of this invention.

The embodiment illustrated in FIGS. 1-7 and 8*a* of the accompanying drawings, and described above, is the present inventor's prototype of the invention. Some variations to and modifications of this prototype embodiment have been indicated already. Other variations and modifications may be made.

For example, all components of the apparatus that have not already been specified as capable of being produced by casting or moulding may be so produced.

Figure 9A:
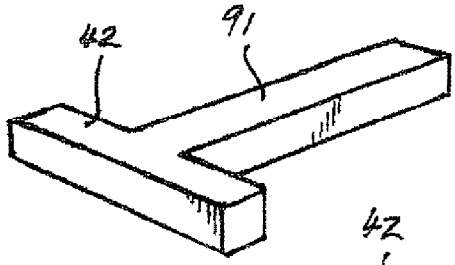
FIGS. 9*a* and 9*b* depict two alternative constructions of the support frame of the present invention.
Figure 9B:
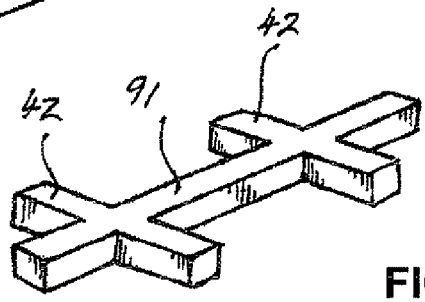

In addition, the support frame 40 that is illustrated in FIGS. 1 to 8 may be 10 replaced with a support frame (examples are shown in FIG. 9) having a single, central, elongate member 91 and one or more transverse members 42. If a support frame having a single elongate member 91 is used, a single post 32 may also be used, with a transverse bar 30 at the top of the single post 32 to support either a pair of padded blocks 131 or a single block having a V-shaped slot in its upper surface. The alternative realisations of the support frame shown in FIG. 9 are not exhaustive.

Figure 10:
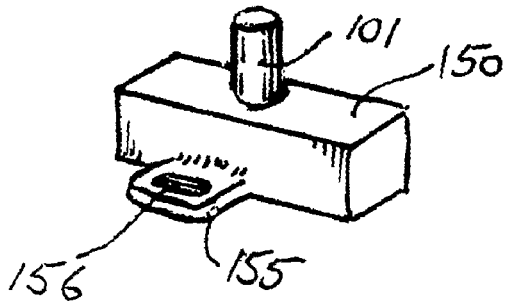
FIG. 10 depicts one alternative form of mounting block that may be used instead of the mounting block 116 shown in FIG. 3.

Also, a different type of mounting block, shown in FIG. 10, may be used instead of the mounting block 116. This different mounting block has a single spigot or post 101 extending upwardly from its centre. The post 101, when the apparatus of this invention is in use, is located within a circular aperture (the post 101 should be a close fit within this aperture) that is in the underside of a transverse member 42 of the support frame 40 (but which, instead, may be in the underside of the elongate member 91 if one of the support frame constructions illustrated in FIG. 9 is used). A variation of the mounting block shown in FIG. 10 is for the post 101 to be threaded and to be long enough to pass through the support frame and project above the top surface of the support frame. A nut may then be used to clamp the support frame to the mounting block.

If one of the support frame constructions illustrated in FIG. 9 is used, the "cradle" assembly of the mounting block 115 shown in FIG. 3 (that "cradle" assembly comprises plates 51, 52 and 53) either (a) will be omitted, or (b) will be duplicated, in which case the two "cradle" assemblies will be positioned on either side of the mounting block 115, so that the single elongate member 91 can be placed between the "cradle" assemblies.

Another alternative mounting block construction comprises a single, threaded, horizontal rod that passes through a threaded horizontal aperture in one (or both) of the elongate members 41 (or the elongate member 91 if one of the arrangements shown in FIG. 9 is used). Rotation of this single threaded rod will move the elongate member(s) to the right or to the left of its (their) "central" position.

Figure 11:
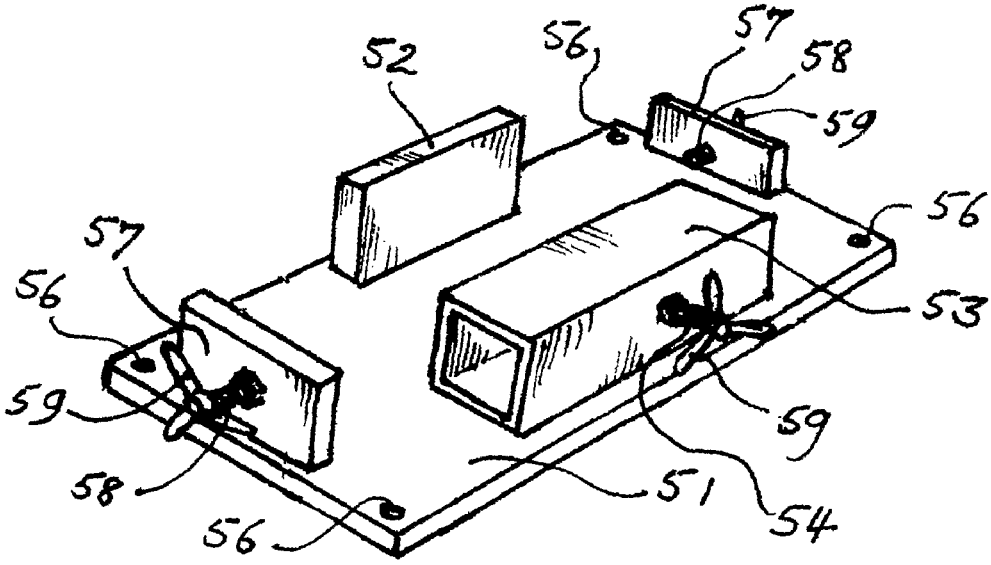
FIG. 11 is a partly schematic perspective sketch of another alternative form of mounting block, which may be used instead of the mounting block 115 shown in FIG. 3.

A further alternative mounting block construction is shown in FIG. 11. This mounting block is a variation of the mounting block 115 shown in FIG. 3, and the reference numerals used in FIG. 11 indicate features which correspond to those in FIG. 3 having the same reference numerals. Engineers will appreciate the construction of the mounting block shown in FIG. 11 and further description of that mounting block is not necessary here.

Yet another alternative mounting block arrangement is with the front and rear mounting blocks constructed as a single entity, which is clamped onto the base 16. With this arrangement, only limited lateral adjustment of the support frame (when in position on the mounting block) is possible and lateral adjustment of the pointing of the gun being sighted in will be effected using only the gun supporting arrangements mounted on the support frame 40.

If the gun to be sighted-in fires high calibre ammunition, significant recoil will be experienced when the gun is fired. For such guns, the rear stock clamping members 21 may be modified to include a butt clamping strap which is connected to the threaded rods 23 and which passes behind the butt of the rear stock 11 of the gun. Such a butt clamping strap—preferably having a length which is adjustable—will assist in preventing recoil slip. Alternatively, or in addition, a block of wood (or other suitable material), preferably shaped to be a close fit around the butt of the rear stock, may be placed between the butt of the rear stock 11 and the pivot block 28 to prevent or minimise recoil slip.

For very powerful guns, the clamping members 21 and the threaded rods 23 may be replaced with a transverse threaded rod which passes through substantially vertical side plates which are rigidly mounted on the support frame, and also through the rear stock of the gun. Nuts (for example, wing nuts) on the transverse threaded rod will be tightened onto the rear stock (preferably with a resilient annular pad and a washer between the rear stock and each washer) to hold the rear stock rigidly in position on this threaded rod.

These alternative constructions are not exhaustive.

The above description of the apparatus or equipment constructed in accordance with the invention has concentrated on the sighting-in of a rifle or shotgun. It should be noted that, provided the length of the support frame is short enough, a pistol can be sighted-in using the same equipment. The rear stock clamping arrangement will clamp the handle of the pistol and the front stock (or barrel) locating means will be a barrel locating means only.

To perform the sighting-in of a gun, the invention may be used in an indoor shooting range, where there is no wind to affect the trajectory of a bullet or a charge of shot.

However, if the invention is used in an outdoor or open (long distance) shooting range, the sighting-in should be performed at a time when there is no wind or thermal air movement.

If the sighting-in is of a rifle (rifle 10 in FIG. 1), the apparatus will be set up as shown in FIG. 1 of the accompanying drawings. The support frame 40 will be mounted on the mounting blocks 115 and 116, which, in turn, are mounted on the base 16, and the rifle will be mounted on the support frame with the clamping members 21 holding the rear stock of the rifle. The base 16 will normally be positioned so that the barrel 13 of the rifle on the support frame 40 is pointing at the region in which targets are displayed. To aim the rifle at a target, the adjusting/clamping screws 58 and 158 on the mounting blocks 115 and 116 are adjusted to move the aim to the left or right, and the adjusting screw (threaded rod) 20 is rotated (after slacking off the adjustment screws 44) to move the aiming point up or down. If the rifle has a telescopic sight with cross hairs, the initial aim of the rifle is effected with the cross hairs vertical and horizontal, and with the intersection point of the cross-hairs or the "dot" on the target. Fine adjustment of the aim may then be effected using the side adjustment screws 44 in conjunction with the adjustment screw (threaded rod) 20.

The usual steps taken to aim a rifle on the prototype apparatus are:

1. Clamp the mounting blocks 115 and 116 to the base 16, and loosen the clamping/adjusting screws 58 and 158.
2. Position the support frame on the mounting blocks 115 and 116 and adjust the clamping/adjusting screws 58 and 158 until the vertical cross-hair or dot of the telescopic sight of the gun (or its open barrel sight) has been moved to the right or left (as required) and is approximately over the range target.
3. Loosen all adjustment screws or bolts 44 and the threaded rod (or rods) 20.
4. Adjust the arms 24 about their pivot points 27 using the threaded rod (or rods) 20, until the horizontal cross-hair (or "dot", or open barrel sight) is above the target.
5. Adjust the screws or bolts 44 so that they bear against the top surface of the side members 41 of the support frame 40, or against the top surface of a transverse member 42 (or, in the absence of a suitably positioned transverse member, a transverse plate or flat-topped bar which is supported on—typically, welded to—the top of the side members 41) of the support frame 40.
6. Tighten each screw or bolt 44 and rod(s) 20 individually to move the cross-hairs across at angles, and up and down, relative to the target, until the intersection of the cross-hairs (or the "dot" or the open barrel sight) is on the target.

When the cross hairs (or the "dot" or open barrel sight) of the rifle sight are on the target, the rifle is properly aimed. A first bullet will now be fired.

The distance between the intended point of impact of the first bullet on the target and its actual point of impact will be noted.

If the distance between the actual point of impact of the bullet and the point at which the rifle was aimed is large, the rifle sights may be adjusted until the rifle-sight is on the actual point of impact on the target. The sighting-in procedure should then be started again with the firing of a new first bullet.

If the distance between the actual point of impact of the first bullet and the point at which the rifle was aimed is not large, the mounting of the rifle on the support frame and the mounting of the support frame on the base is not changed, but the sights of the rifle (whether telescopic sights or open sights) are adjusted until they show that the rifle is aimed at the actual point of impact of the bullet on the target. The rifle is then fired again. The second bullet should impact on the target at substantially the same point as the first bullet struck it. If this is the case, the rifle is now sighted-in.

If there is a significant difference between the intended point of impact of the second bullet (which is, of course, the actual point of impact of the first bullet) and its actual point of impact, that will be probably be due to air movement (caused by wind, humidity changes, or thermal activity over the range), or to variation in the cartridge loading, or the use of inferior ammunition (that is, ammunition which is not suitable for the rifle that is being sighted-in). In this situation, the sighting-in procedure should be repeated in still air, or a third bullet should be fired to check the sights of the rifle and the adjustments that have been made to the aiming of the rifle.

A similar procedure will be used for the sighting-in of a scoped pistol.

When sighting-in a shotgun, it is the centre of the group of points of impact of shot from a cartridge that is used as the intended point of impact. Thus, knowing the points of impact, the distance from the target, and the type of cartridge used, it is possible to adjust the aiming of the shotgun to put the centre of the group of shot on the centre of the target.

If a high powered, scoped, centre fire rifle, or a shotgun, is being sighted-in and the cross-hairs of the riflesight move due to the recoil action when the first bullet is fired, the grip of the rear stock clamping members 21 should be increased, or a block of wood (or other suitable material) should be placed between the butt of the stock 11 and the pivot block 28 to prevent recoil slip, and the rifle should be realigned using the adjustment screws or bolts 44 and the threaded rod or rods 20, or the adjustment screws 58 and 158 (until the cross-hairs of the gunsight are again on the intended point of impact on the target). The sighting-in procedure should then be started again with the firing of a new first bullet.

When using a centre fire rifle, the accuracy of the rifle is affected by the cartridges used. Different cartridges have differing powder type, powder charge capacity, projectiles, grains and weights. (The rifle configuration and variations in the ammunition charge are also factors that affect the shooter's accuracy with the rifle.) Thus, again, a shooter should experiment with different ammunition types and cartridge loadings to ascertain which is the most appropriate ammunition for the rifle. When testing different ammunition types, five shots from each type should be fired at respective target sheets. The resultant groupings on the targets will show which ammunition is the one to use with the rifle (the closer the grouping, the more suitable the ammunition is for use with the rifle).

Once a rifle has been sighted-in, a shooter, when competing in an event at a rifle range, can (1) fire a test shot with the rifle aimed at the centre (the bull) of a practice target, (2) note the difference between the intended point of impact of the bullet and its actual point of impact, and (3) use this information to adjust the point at which the rifle should be aimed when shooting at a competition target. If the competition is being held in an open air range, the shooter should fire at the competition target as soon as possible after the practice shot, so that the possibility of a change in the wind speed and/or direction occurring after the practice shot (both changes will affect the trajectory of a bullet from a rifle) is minimised. If the rules of the competition permit it, a sighting or practice shot should be made before each shot at a target of the competition.

The invention claimed is:

1. An apparatus for use in sighting-in of a gun, said gun having a barrel, a rear stock and a front stock, said rear stock having two side faces, said apparatus comprising:

a) a generally elongated support frame having a front end and a back end;

b) a base on which said support frame is mounted;

c) a front stock locating device being mounted on said support frame at or near said front end, said front stock locating device comprising:

(1) a first horizontal bar supported above said support frame, and extending in a direction transverse to an elongate direction of said support frame; and (2) a prevention of sideways movement device for prevention of sideways movement of said front stock, said prevention of sideways movement device being mounted on said first horizontal bar;

d) a rear stock clamping device being mounted on said support frame at or near said back end, said rear stock clamping device comprising a pair of stock clamping members, each stock clamping member having a substantially vertical surface which is opposed to a substantially vertical surface of another said stock clamping member, each of said stock clamping members being moveable laterally relative to said elongate direction of said support frame, so that when said apparatus is in use, each of said vertical surfaces may be moved to contact a respective side face of said rear stock, each said stock clamping member being mounted on a respective axle at an end of a respective horizontal rod which extends away from an associated said stock clamping member in a direction substantially at right angles to both said substantially vertical surfaces of said clamping members and said elongate direction of said support frame, each horizontal rod having a portion thereof which is externally threaded, each said horizontal rod passing through an internally threaded aperture in a respective support block, with said externally threaded portion engaging with internal threads of said internally threaded aperture, whereby rotation of each horizontal rod causes its associated axle to move towards or away from said rear stock and thereby provide said lateral movement of each stock clamping member; and e) an adjustment device for increasing and decreasing a distance between said support blocks and said support frame, thereby when using said apparatus, raising or lowering said rear stock relative to said support frame, and lowering or raising said band of said gun relative to said rear stock;

said prevention of sideways movement device comprises a block mounted on said first horizontal bar, and said block mounted on said first horizontal bar comprises:

an upper surface which is remote from said first horizontal bar, and a generally V-shaped slot formed therein, said slot extending from said upper surface; said slot having dimensions which permit said front stock to be firmly positioned within said slot.

2. An apparatus for use in sighting-in of a gun, said gun having a barrel and a rear stock, said rear stock having two side faces, said apparatus comprising:

a) a generally elongated support frame having a front end and a back end;

b) a base on which said support frame is mounted;

c) a barrel locating device being mounted on said support frame at or near said front end, said barrel locating device comprising:

(1) a first horizontal bar supported above said support frame, and extending in a direction transverse to an elongate direction of said support frame; and (2) a prevention of sideways movement device for prevention of sideways movement of said barrel, said prevention of sideways movement device being mounted on said first horizontal bar;

d) a rear stock clamping device being mounted on said support frame at or near said back end, said rear stock clamping device comprising a pair of stock clamping members, each stock clamping member having a substantially vertical surface which is opposed to a substantially vertical surface of another stock clamping member, each of said stock clamping members being moveable laterally relative to an elongate direction of said support frame, so that when using said apparatus, each of said vertical surfaces may be moved to contact a respective side face of said rear stock, each said stock clamping member being mounted on a respective axle at an end of a respective horizontal rod which extends away from the associated stock clamping member in a direction substantially at right angles to both said substantially vertical surfaces of said clamping members and said elongate direction of said support frame, each said horizontal rod having a portion thereof which is externally threaded, each said horizontal rod passing through an internally threaded aperture in a respective support block, with said externally threaded portion engaging with internal threads of said internally threaded aperture, whereby rotation of each said horizontal rod causes its associated axle to move towards or away from said rear stock and thereby provides said lateral movement of each stock clamping member; and e) an adjustment device for increasing and decreasing the distance between said support blocks and said support frame, when using said apparatus to raise or lower said rear stock relative to said support frame, and thus to lower or raise said barrel of said gun relative to said rear stock;

wherein said adjustment device comprises:

a pair of elongate arms which have their elongate direction parallel to said elongate direction of said support frame;

each said support block being mounted on one end of a respective one of said elongate arms;

other ends of said elongate arms being connected to, and being joined together by, a second horizontal bar;

each of said elongate arms being mounted, at a corresponding point between said ends of said elongate arms, on a respective pivot axle that extends from a pivot block that is mounted on said support frame; and a worm and nut drive, with the nut thereof formed in or attached to said second horizontal bar, being operative to raise and lower said second horizontal bar and thereby rotate said elongate arms about said pivot axles, to lower or raise said support blocks and thus lower or raise said stock clamping members.

3. The apparatus of claim 2, further including two additional worm and nut drives, each of said additional worm and nut drives being associated with a respective one of said elongate arms, with the nut thereof formed in or attached to said respective elongate arm in a position between the associated pivot axle and the associated support block.

4. The apparatus of claim 2, in which said prevention of sideways movement device comprises a pair of blocks which (a) are moveable along an upper surface of said first horizontal bar, and (b) are clampable onto said first horizontal bar.

5. The apparatus of claim 4, in which each of said blocks of said prevention of sideways movement device has an inner face which is padded.

6. The apparatus of claim 4, in which at least a central portion of said upper surface of said first horizontal bar is covered with a layer of a resilient material.

7. The apparatus of claim 2, wherein said first horizontal bar has an upper surface and said block includes a generally V-shaped slot formed therein, and said block:

(a) is moveable along said upper surface of said first horizontal bar; and (b) is clampable onto said first horizontal bar.

8. The apparatus of claim 2, wherein a height of said first horizontal bar above said support frame is variable.

9. The apparatus of claim 2, wherein said support frame comprises a pair of elongate side members and at least two transverse members which extend between and are connected to said side members.

10. The apparatus of claim 9, in which said support frame is mounted on a pair of mounting blocks positioned, respectively, one towards the front end of said support frame and the other towards the back end of said support frame, each mounting block being rigidly secured to said base.

11. The apparatus of claim 10, in which one of said mounting blocks includes a cradle into which a transverse member of said support frame may be positioned; said cradle comprising:

a) a horizontal plate having a forward edge and a rearward edge;

b) a first planar, vertical plate extending upwardly from said forward edge;

c) a second planar, vertical plate extending upwardly from said rearward edge; and d) at least one clamping member operatively connected to said first vertical plate or to said second vertical plate, for clamping a transverse member of said support frame between said first and second vertical plates.

12. The apparatus of claim 11, in which said mounting block that includes said cradle is an elongate transverse mounting block member and the planes of said first and second vertical plates are parallel to the elongate direction of said transverse block member, and a) a third planar vertical plate and a fourth planar vertical plate extend upwardly from respective ends of said transverse mounting block member;

b) the planes of said third and fourth vertical plates are perpendicular to the elongate direction of said transverse block member;

c) said third and fourth vertical plates are spaced apart a distance greater than the distance between the outer edges of said side members of said support frame; and d) either:

(1) a further clamping member is operatively connected to said third vertical plate or said fourth vertical plate; or (2) a respective further clamping member is operatively connected to said third vertical plate and said fourth vertical plate, for clamping said side members of said support frame between said third and fourth vertical plates.

13. The apparatus of claim 12, wherein said transverse mounting block member has a lowermost surface that is engaged with an uppermost surface of said base, and a second horizontal plate connected to said transverse mounting block member adjacent to said lowermost surface, an elongate slot being formed in said second horizontal plate, through which a bolt extending from or into said base may pass.

14. The apparatus of claim 12, wherein another of said mounting blocks comprises a second elongate block member mounted on said base with the elongate direction of said second block member being transverse the elongate direction of said support frame, characterised in that:

a) a fifth planar vertical plate and a sixth planar vertical plate extend upwardly from respective ends of said second block member, the planes of said fifth and sixth vertical plates being perpendicular to the elongate direction of said second block member;

b) said fifth and sixth vertical plates are spaced apart a distance greater than the distance between the outer edges of said side members of said support frame; and c) either:

(1) an additional clamping member is operatively connected to said fifth vertical plate or said sixth vertical plate; or (2) a respective additional clamping member is operatively connected to said fifth vertical plate and said sixth vertical plate, for clamping said side members of said support frame between said fifth and sixth vertical plate.

15. The apparatus of claim 11, wherein:

a) each transverse member of said support frame has an upper side and an underside;

b) one of said mounting blocks comprises a second block member mountable on said base; and c) a post extending vertically upwards from the top surface of said second block member, said post being dimensioned to be a close fit within an aperture in the underside of a transverse member of said support frame.

16. The apparatus of claim 15, wherein, (a) said post has a length sufficient to pass upwardly through, and extend above, said support frame; and (b) said post is threaded, so that a nut thereon may be tightened to hold said support frame securely on said second block member.

17. The apparatus of claim 2, wherein said support frame comprises two sub-frames, characterised in that:

a) each sub-frame has a pair of elongate, linear, parallel side members, said side members being connected by at least one transverse member;

b) each side member of one sub-frame is hollow or has a central elongate cavity extending thereinto from one end thereof over at least part of its length; and c) the spacing of and the dimensions of the side members of the other sub-frame are such that the side members of the other sub-frame fit within either (1) said hollow side members of said one subframe, or (2) said elongate cavities of said one sub-frame, to form said support frame, and a means for retaining being provided to hold said sub-frames firmly in position relative to each other.

18. The apparatus of claim 2, wherein said support frame comprises two sub-frames, characterised in that:

a) each sub-frame has a pair of elongate, linear, parallel side members, said side members being connected by at least one transverse member;

b) each side member of a sub-frame is hollow or has a central elongate cavity extending thereinto from one end thereof over at least part of its length; and c) said support frame is formed by inserting a pair of frame support rods into respective co-linearly aligned side members of said sub-frames, and a means for retaining being provided to hold said sub-frames firmly in position on said frame support rods.

19. The apparatus of claim 2, wherein said support frame comprises a single elongate member mounted on said base with its elongate direction in the fore-and-aft direction of said apparatus, and at least one transverse member extends across said single elongate member.

20. An apparatus for use in sighting-in of a gun, said gun having a barrel and a rear stock, said rear stock having two side faces, said apparatus comprising:

a) a generally elongated support frame having a front end and a back end;

b) a base on which said support frame is mounted;

c) a barrel locating device being mounted on said support frame at or near said front end, said barrel locating device comprising:

(1) a first horizontal bar supported above said support frame, and extending in a direction transverse to an elongate direction of said support frame; and (2) a prevention of sideways movement device for prevention of sideways movement of said barrel, said prevention of sideways movement device being mounted on said first horizontal bar;

d) a rear stock clamping device being mounted on said support frame at or near said back end, said rear stock clamping device comprising a pair of stock clamping members, each stock clamping member having a substantially vertical surface which is opposed to a substantially vertical surface of another stock clamping member, each of said stock clamping members being moveable laterally relative to an elongate direction of said support frame, so that when using said apparatus, each of said vertical surfaces may be moved to contact a respective side face of said rear stock, each said stock clamping member being mounted on a respective axle at an end of a respective horizontal rod which extends away from the associated stock clamping member in a direction substantially at right angles to both said substantially vertical surfaces of said clamping members and said elongate direction of said support frame, each said horizontal rod having a portion thereof which is externally threaded, each said horizontal rod passing through an internally threaded aperture in a respective support block, with said externally threaded portion engaging with internal threads of said internally threaded aperture, whereby rotation of each said horizontal rod causes its associated axle to move towards or away from said rear stock and thereby provides said lateral movement of each stock clamping member; and e) an adjustment device for increasing and decreasing the distance between said support blocks and said support frame, when using said apparatus to raise or lower said rear stock relative to said support frame, and thus to lower or raise said barrel of said gun relative to said rear stock;

said prevention of sideways movement device which comprises a block mounted on said first horizontal bar; and said block mounted on said first horizontal bar comprises:

an upper surface which is remote from said first horizontal bar; and a generally V-shaped slot formed therein, said slot extending from said upper surface; said slot having dimensions which permit said barrel to be firmly positioned within said slot.

* * * * *